US009444180B2

(12) United States Patent
Goulbourne

(10) Patent No.: US 9,444,180 B2
(45) Date of Patent: Sep. 13, 2016

(54) CONNECTOR STRAIN RELIEF ASSEMBLY

(71) Applicant: Wesley Goulbourne, Prospect Park, PA (US)

(72) Inventor: Wesley Goulbourne, Prospect Park, PA (US)

( * ) Notice: Subject to any disclaimer, the term of this patent is extended or adjusted under 35 U.S.C. 154(b) by 18 days.

(21) Appl. No.: 14/550,837

(22) Filed: Nov. 21, 2014

(65) Prior Publication Data

US 2015/0222048 A1 Aug. 6, 2015

Related U.S. Application Data

(60) Provisional application No. 61/965,681, filed on Feb. 5, 2014.

(51) Int. Cl.

| | |
|---|---|
| ***H01R 13/56*** | (2006.01) |
| ***H01R 13/58*** | (2006.01) |
| *H01R 13/506* | (2006.01) |
| *H01R 35/02* | (2006.01) |

(52) U.S. Cl.

CPC ..... *H01R 13/5841* (2013.01); *H01R 13/506* (2013.01); *H01R 13/5845* (2013.01); *H01R 35/02* (2013.01); *Y10T 29/49195* (2015.01)

(58) Field of Classification Search

CPC ..... H01R 35/02; H01R 13/506

USPC ..... 439/445–447, 8

See application file for complete search history.

(56) References Cited

U.S. PATENT DOCUMENTS

| | | | | |
|---|---|---|---|---|
| 1,276,117 | A * | 8/1918 | Riebe | F16C 1/26 138/120 |
| 3,858,578 | A * | 1/1975 | Milo | A61B 17/02 600/229 |
| 6,164,570 | A * | 12/2000 | Smeltzer | F16L 11/18 138/120 |
| 6,648,376 | B2 * | 11/2003 | Christianson | F16L 11/18 138/120 |
| 6,854,768 | B2 * | 2/2005 | Elder | B29C 45/0003 285/146.1 |
| 7,533,906 | B2 * | 5/2009 | Luettgen | H01R 35/00 285/146.1 |
| 2006/0079121 | A1 * | 4/2006 | Bruno | H01R 35/02 439/502 |

* cited by examiner

*Primary Examiner* — Tho D Ta

(74) *Attorney, Agent, or Firm* — Joseph Stecewycz

(57) ABSTRACT

Disclosed is a connector strain relief assembly comprising: a connector adapter having a first connector adapter end configured to fit over an electrical connector, and a second connector adapter end having a substantially spherical shape; a cable adapter having a first cable adapter end configured to fit over an electrical cable, and a second cable adapter end having a substantially spherical shape; and, a ball-joint connector having a link socket end and a link ball end attached to the connector adapter and to the cable adapter.

12 Claims, 9 Drawing Sheets

CONNECTOR STRAIN RELIEF ASSEMBLY

CROSS REFERENCE TO RELATED APPLICATION

The present Application is related to Provisional Patent Application entitled "Connector Strain Relief Assembly," filed 5 Feb. 2014 and assigned filing No. 61/965,681, incorporated herein by reference in its entirety.

FIELD OF THE INVENTION

The present invention relates to a system and method for protecting electrical cables at cable-connector junctions and, more particularly, to a connector strain relief assembly adapted for use at such cable-connector junctions.

BACKGROUND OF THE INVENTION

It has been known in the art for some years that most of the population is in a new era of dependence on technology. Such technology needs power to enable the public to continue working and playing. While companies have designed beautiful, integrative technology, they have neglected one aspect in particular. That would be electrical cable/connector assemblies used for communication and power.

Conventional electrical cable assemblies have developed a reputation for breaking and/or failing in use. The primary causes for such breakages are lack of any strain relief components, or the use of ineffective strain relief designs.

What is needed is an improved strain relief system that allows an electrical cable to move naturally, but which functions to prevent the occurrence of harsh bends at the cable/connector junction.

BRIEF SUMMARY OF THE INVENTION

In one aspect of the present invention, a connector strain relief assembly suitable for placement over the junction of an electrical cable and an attached electrical connector, comprises: a connector adapter having (i) a first connector adapter end configured to fit over the electrical connector and (ii) a second connector adapter end, a portion of a surface of the second connector adapter end having a substantially spherical shape; a cable adapter having (i) a first cable adapter end configured to fit over the electrical cable, and (ii) a second cable adapter end, a portion of a surface of the second cable adapter end having a substantially spherical shape; and, a ball-joint connector having a link socket end and a link ball end, one of the link socket end and the link ball end rotatably attached to the connector adapter, and the other of the link socket end and the link ball end rotatably attached to the cable adapter.

In another aspect of the present invention, an electrical cable assembly suitable for providing conductive paths for electrical signals and electrical power between a first external electrical connector and a second external electrical connector, said electrical cable assembly comprises: a first electrical connector configured to mate with the first external connector; a second electrical connector configured to mate with the second external connector; an electrical cable connected to the first electrical connector to form a first junction, the electrical cable further connected to the second electrical connector to form a second junction; a first connector strain relief assembly disposed over the first junction, the first connector strain relief assembly including (i) a first connector adapter partially enclosing the first electrical connector, (ii) a first ball-joint connector attached to the first connector adapter, and (iii) a first cable adapter rotatably attached to the first ball-joint connector; and, a second connector strain relief assembly disposed over the second junction, the second connector strain relief assembly including (i) a second connector adapter partially enclosing the second electrical connector, (ii) a second ball-joint connector rotatably attached to the second connector adapter, and (iii) a second cable adapter rotatably attached to the second ball-joint connector.

In still another aspect of the present invention, a method for providing strain relief for the junction of an electrical cable and an electrical connector comprises: placing a cable adapter over the electrical cable, the cable adapter having a cable end in contact with the electrical cable and a second end facing the junction; placing a ball-joint connector over the electrical cable; placing a connector adapter over the electrical cable; rotatably attaching the cable adapter to one end of the ball-joint connector; rotatably attaching a first end of the connector adapter to a second end of the ball-joint connector; and, attaching the electrical connector to the electrical cable.

The additional features and advantage of the disclosed invention is set forth in the detailed description which follows, and will be apparent to those skilled in the art from the description or recognized by practicing the invention as described, together with the claims and appended drawings.

BRIEF DESCRIPTIONS OF THE DRAWINGS

The foregoing aspects, uses, and advantages of the present invention will be more fully appreciated as the same becomes better understood from the following detailed description of the present invention when viewed in conjunction with the accompanying figures, in which.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention.

The present invention relates generally to a strain relief assembly that includes moveable segments, and is molded onto an electrical cable at a connector junction, to provide strain relief and prevent cable breakage at the connector. The configuration of the disclosed strain relief assembly avoids the common necessity to replace electrical signal and data cables, as the strain relief assembly restricts the amount of movement the electrical cable can makes at the attached connector.

Figure 1:
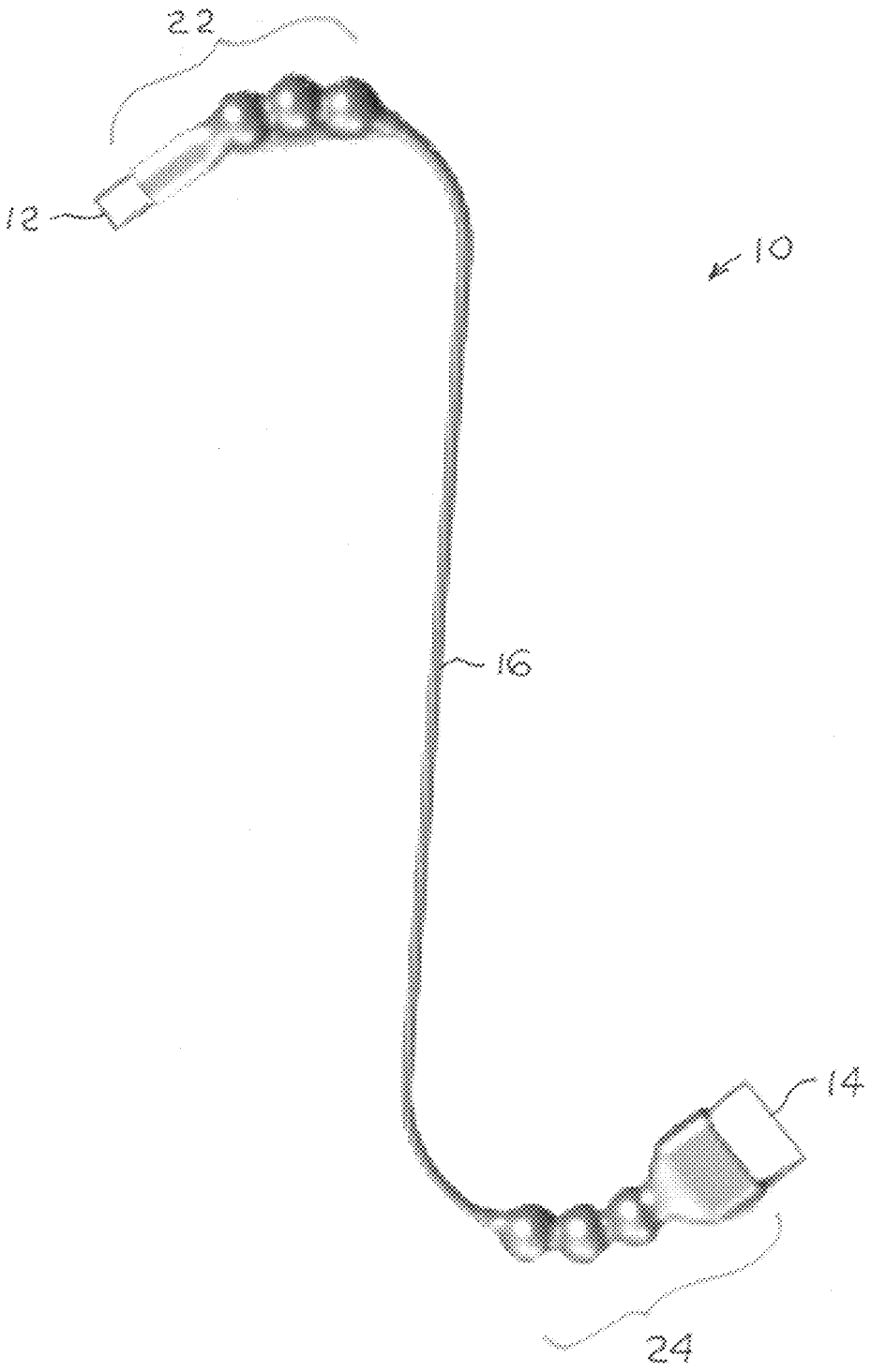
FIG. 1 is a diagrammatical illustration of an electrical cable assembly including strain relief assemblies at cable-connector junctions, in accordance with the present invention.

There is shown in FIG. 1 an electrical cable assembly 10 in accordance with the present invention. The electrical cable assembly 10 includes a first electrical connector 12 electrically connected to a second electrical connector 14 by means of an electrical cable 16, as is well-known in the art. The electrical cable 16 may include a plurality of electrical conductors suitable for data and power transmission between the electrical connectors 12, 14, for example. In the particular embodiment shown, the first electrical connector 12 is configured as a nine-pin cell phone male connector and the second electrical connector 14 is configured as a USB male connector. It should be understood that any type of male or female electrical connector may be used at an end of the electrical cable assembly 10. It should further be understood that the electrical cable may be singly or multiply-branched, and that more than two electrical connectors may be included in an electrical cable assembly (not shown).

The electrical cable assembly 10 may further include: (i) a first strain relief assembly 22 disposed over a portion of the electrical cable 16 and the first electrical connector 12, and (ii) a second strain relief assembly 24 disposed over a portion of the electrical cable 16 and the second electrical connector 14. It can be appreciated by one skilled in the art that the electrical cable assembly 10 can be adapted for protection of an electrical cable connector in other applications, such as plugs for laptop computers and other consumer electronics such as audio headphones, at a 3.5 mm jack section, for example. The electrical cable assembly 10 can also be adapted for use with cell phone chargers and various types of data cables. Although the strain relief assemblies 22, 24 are shown as black or dark grey in color, the strain relief assemblies 22, 24 may be provided in any of a variety of colors, and may match or contrast with the color of the electrical cable 16.

Figure 2:
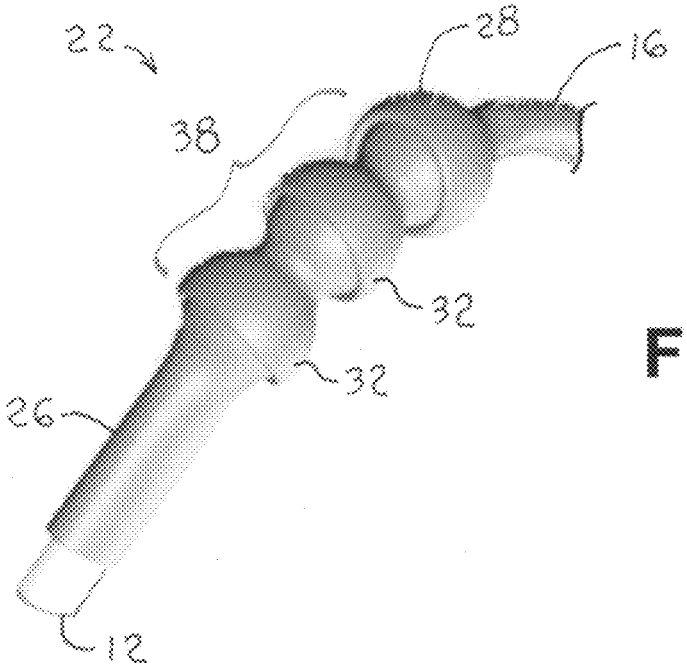
FIG. 2 is a detail diagrammatical view of a first strain relief assembly in FIG. 1.
Figure 3:
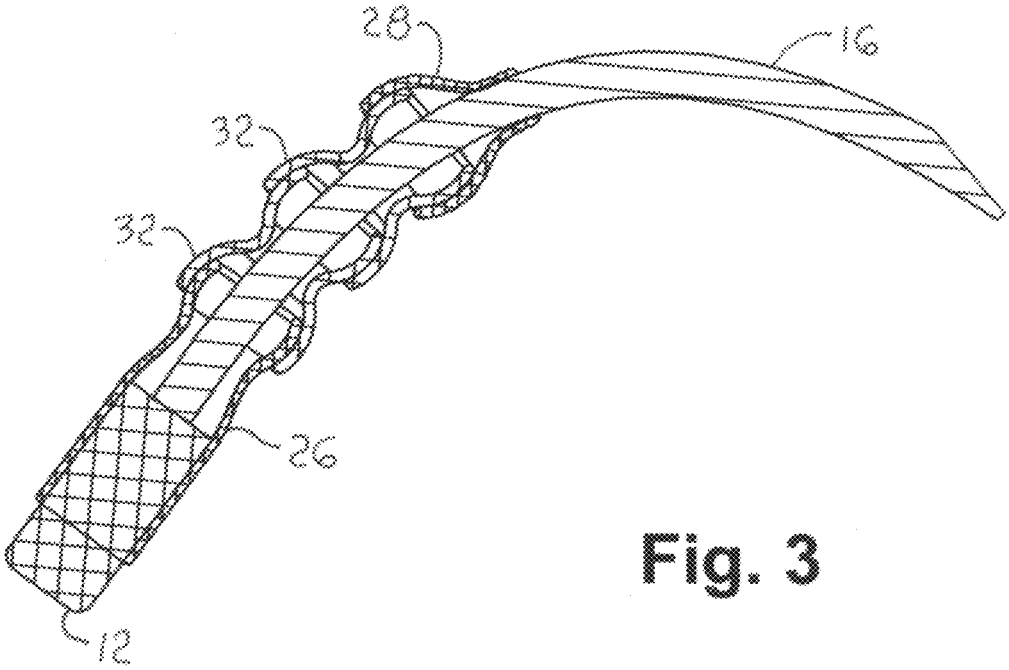
FIG. 3 is a cross-sectional diagrammatical view of the strain relief assembly of FIG. 2.

FIGS. 2 and 3 show a detailed view, and a cross-sectional view, respectively, of the strain relief assembly 22. A connector adapter 26 is preferably molded onto the first electrical connector 12, essentially as shown. A first ball-joint link 32 is rotatably attached to the first connector adapter 26, essentially as shown. In the exemplary embodiment shown in FIGS. 1-3, an optional second ball-joint link 32 is rotatably attached to the first ball-joint link 32, essentially as shown. The first ball-joint link 32 and the optional second ball-joint link 32 form a ball-joint connector 38.

A cable adapter 28 is rotatably attached to the second first ball-joint link 32, essentially as shown. The connector adapter 26, the ball-joint links 32, and the cable adapter 28 are form a hollow configuration, as described in greater detail below, so as to allow the electrical cable 16 to pass completely through the strain relief assembly 22, from the cable adapter 28 to the first electrical connector 12, for mechanical and electrical attachment to the first electrical connector 12.

It can be appreciated by one skilled in the art that an exemplary embodiment of a strain relief assembly (not shown) may comprise: (i) a connector adapter having a socket end, (ii) a ball-joint connector 38 in reversed orientation from that shown in FIGS. 2 and 3, and (iii) a cable adapter having a ball end. In addition, the ball-joint connector 38 may comprise: (i) only a single ball-joint link 32 (i.e., without the optional second ball-joint link 32) for applications in which space may be limited, or (ii) three or more ball-joint links 32 where available space may be convoluted.

Figure 4:
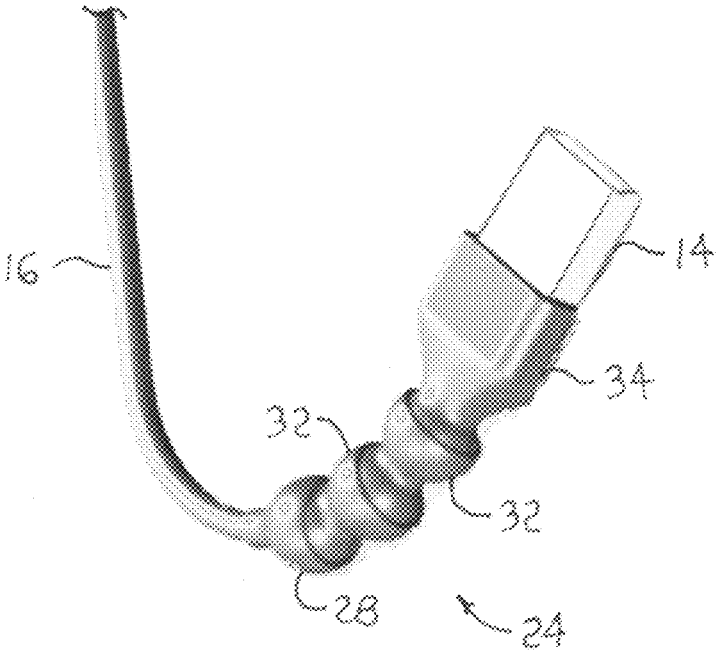
FIG. 4 is a detail diagrammatical view of a second strain relief assembly in FIG. 1.
Figure 5:
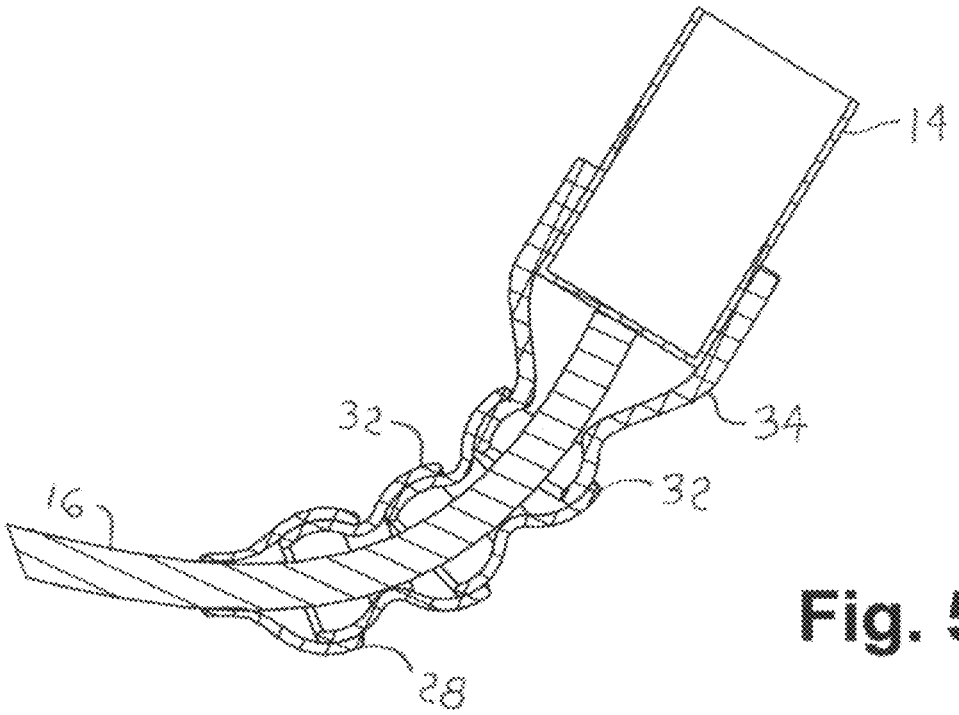
FIG. 5 is a cross-sectional diagrammatical view of the strain relief assembly of FIG. 4.

FIGS. 4 and 5 show a detailed view, and a cross-sectional view, respectively, of the strain relief assembly 24. A connector adapter 34 is preferably molded onto the second electrical connector 14, essentially as shown. A third ball-joint link 32 is rotatably attached to the connector adapter 34, essentially as shown. In the exemplary embodiment shown in FIGS. 1, 4-6, a fourth, optional ball-joint link 32 is rotatably attached to the third ball-joint link 32, essentially as shown, to extend and enhance the strain relief function. A cable adapter 28 is rotatably attached to the fourth ball-joint link 32, essentially as shown. The connector adapter 34 is also hollow, as described in greater detail below, so as to allow the electrical cable 16 to pass through the strain relief assembly 24, for mechanical and electrical attachment to the second electrical connector 14.

Figure 6:
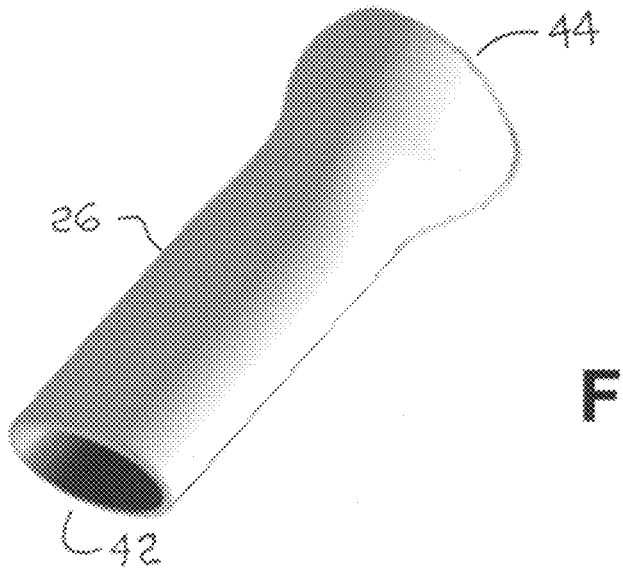
FIG. 6 is a detail diagrammatical view of a first connector adapter in the strain relief assembly of FIG. 2.
Figure 7:
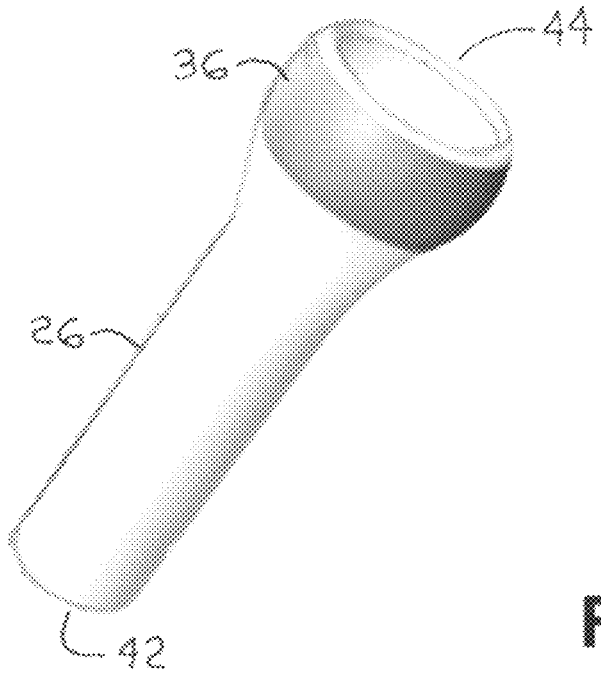
FIG. 7 is a diagrammatical view of the first connector adapter of FIG. 6.

FIGS. 6 and 7 show detailed views of the hollow connector adapter 26. The connector adapter 26 includes a connector end 42, sized and generally cylindrically-shaped so as to fit over the first electrical connector 12. The connector end 42 has a length selected to frictionally retain the connector end 42 on the first electrical connector 12, while allowing the first electrical connector 12 to be mated with a connector on an external device without interference from the connector end 42. The connector adapter 26 also includes a ball end 44, sized and spherically shaped for rotatable attachment into the ball-joint link 32. In accordance with the present invention, the approximate geometry of a bearing surface on the connector adapter 26 that generally remains in contact with an inner surface 56 (shown in FIG. 9) of the hollow ball-joint link 32, is indicated in the illustration by a dark circumferential band 36.

Figure 8:
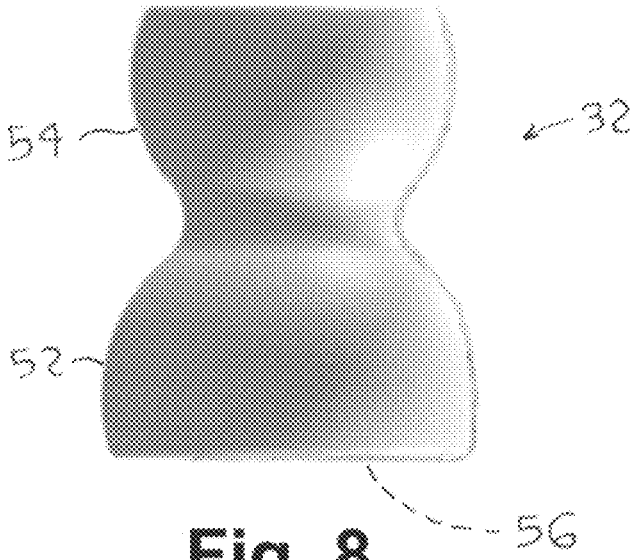
FIG. 8 is detail diagrammatical view of a ball-socket link in the strain relief assembly of FIG. 2.
Figure 9:
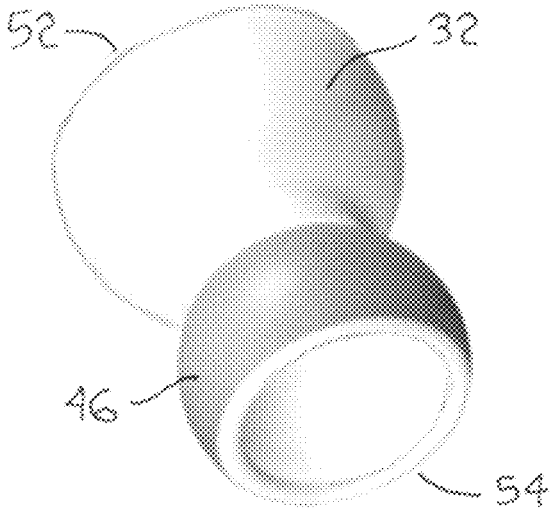
FIG. 9 is a diagrammatical view of the ball-socket link of FIG. 8.

FIGS. 8 and 9 show detailed views of the hollow ball-joint link 32. The ball-joint link 32 includes a socket end 52, sized and generally spherically-shaped for rotatable attachment over the ball end 44 of the electrical connector 12. The ball-joint link 32 also includes a ball end 54, sized and spherically shaped for rotatable attachment into the socket end 52 of an adjacent ball-joint link 32 (not shown). It can be appreciated by one skilled in the art that the socket end 52 of the ball-joint link 32 is also sized and generally spherically-shaped for rotatable attachment over the ball end 54 of an adjacent ball-joint link 32. In accordance with the present invention, the approximate geometry of a bearing surface on the ball-joint link 32 that generally conforms to and remains in contact with the inner surface 56 of the hollow ball-joint link 32, is indicated in the illustration by a dark circumferential band 46.

Figure 10:
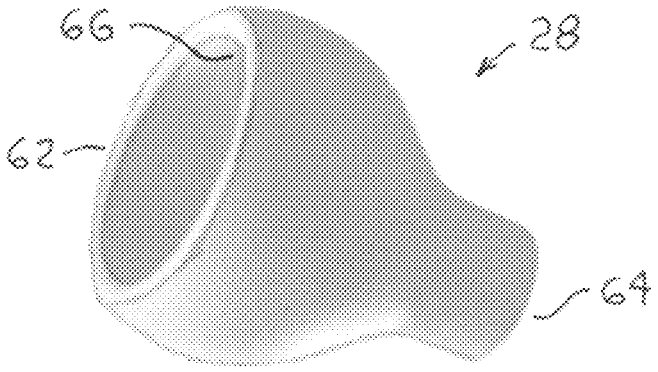
FIG. 10 is detail diagrammatical view of a cable adapter in the strain relief assembly of FIG. 2.
Figure 11:
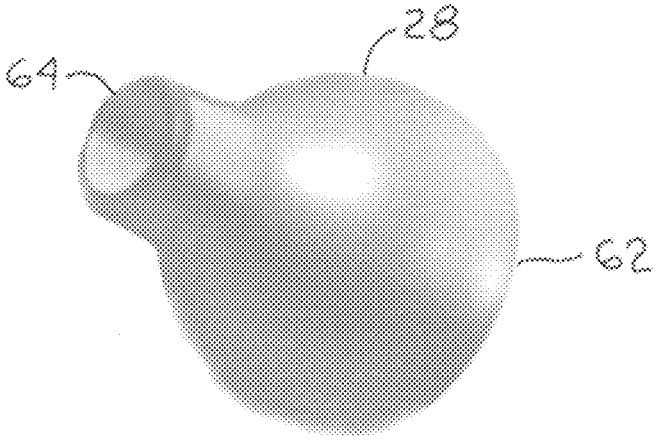
FIG. 11 is diagrammatical view of the cable adapter of FIG. 10.

FIGS. 10 and 11 show detailed views of the hollow cable adapter 28. The cable adapter 28 includes a socket end 62, sized and generally spherically-shaped for rotatable attachment over the ball end 54 of an adjacent ball-joint link 32. The interior surface 66 of the socket end 62 generally conforms to and remains in contact with the bearing surface of the ball end 54 of the hollow ball-joint link 32, indicated by the dark circumferential band 46. The cable adapter 28 also includes a cable end 64, sized and generally spherically-shaped for frictional attachment onto the electrical cable 16.

Figure 12:
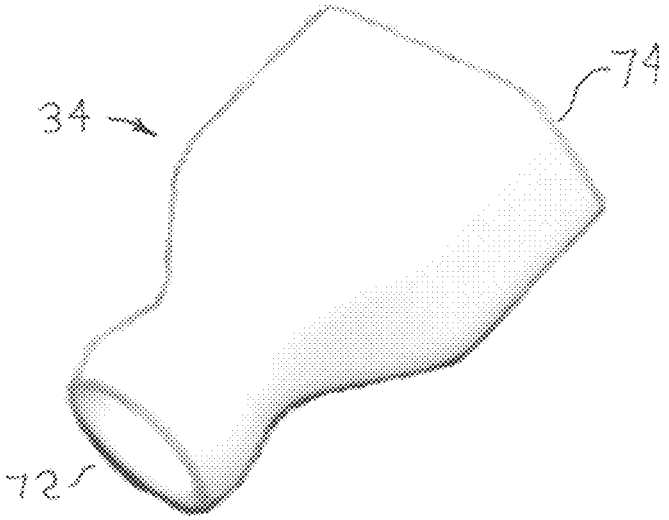
FIG. 12 is a diagrammatical view of a second connector adapter in FIG. 4.
Figure 13:
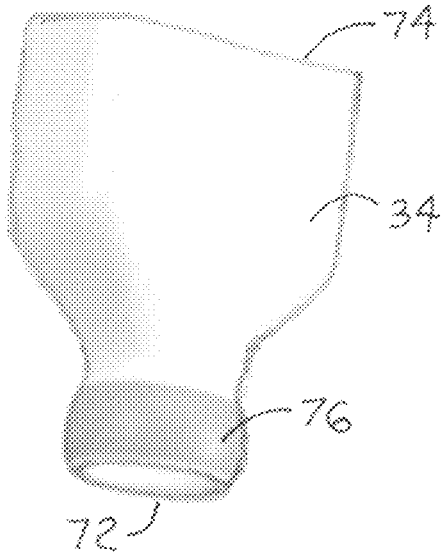
FIG. 13 is a diagrammatical view of the second connector adapter of FIG. 12.

FIGS. 12 and 13 show detailed views of the hollow connector adapter 34. The connector adapter 34 includes a ball end 72, sized and generally spherically-shaped for rotatable attachment into the socket end 62 of an adjacent ball-joint link 32. In accordance with the present invention, the approximate geometry of a bearing surface on the connector adapter 34 that generally conforms to and remains in contact with the inner surface 56 of the hollow ball-joint link 32, is indicated in the illustration by a dark circumferential band 76. The connector adapter 34 also includes a connector end 74, sized and shaped for frictional attachment or molding onto the second electrical connector 14. It can be appreciated by one skilled in the art that the connector end 74 may be similar in size and shape to the connector end 42 of the connector adapter 26, for cable assembly configurations in which the second electrical connector 14 is similar to the first electrical connector 12.

The above-described individual components of the first strain relief assembly 22 and the second strain relief assembly 24 thus each have a measure of relative movement within the respective strain relief assembly. The individual components may be fabricated from a flexible plastic or rubber material, such as PVC and thermoplastic rubber. This measure of movement allow for a 360-degree spin within a ball joint, but limit side-to-side and up-and-down movements within the ball joint. This configuration provides the innovative and advantageous strain relief function by preventing the enclosed electrical cable 16 from flexing more than about 45 degrees to about 65 degrees.

Figure 14:
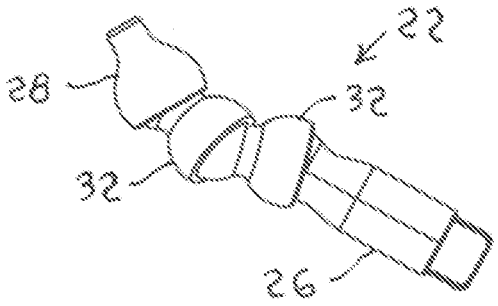
FIG. 14 is a diagrammatical view showing relative motion of the components of the strain relief assembly in FIG. 2.
Figure 15:
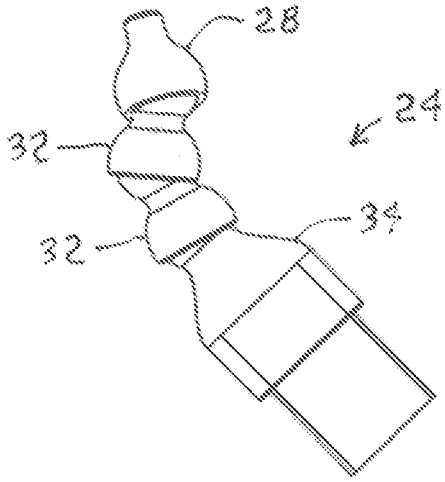
FIG. 15 is a diagrammatical view showing relative motion of the components of the strain relief assembly in FIG. 4; and, FIG. 16 is a diagrammatical view of an exemplary embodiment of a connector-to-cable interface with additional mechanical integrity provided by a cable strain relief adapter.

This restrictive movement is shown in the illustration of first strain relief assembly 22, in FIG. 14, and the second strain relief assembly 24, in FIG. 15. In FIG. 14, (i) the first ball-joint link 32 is at a maximum side-to-side movement relative to the first connector adapter 26, (ii) the second ball-joint link 32 is at a maximum side-to-side movement relative to the first ball-joint link 32, and (iii) the cable adapter 28 is at a maximum side-to-side movement relative to the second ball-joint link 32. In FIG. 15, (i) the third ball-joint link 32 is at a maximum side-to-side movement relative to the connector adapter 34, (ii) the fourth ball-joint link 32 is at a maximum side-to-side movement relative to the third ball-joint link 32, and (iii) the cable adapter 28 is at a maximum side-to-side movement relative to the fourth ball-joint link 32.

Figure 16:
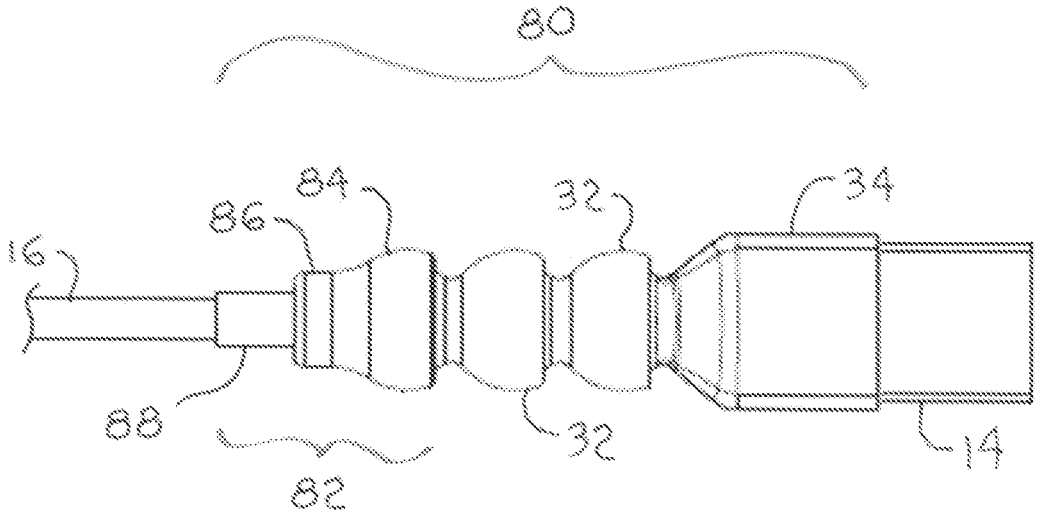

In an exemplary embodiment, shown in FIG. 16, a strain relief assembly 80 is configured to provide additional mechanical integrity to a cable-connector junction. In the illustration provided, the strain relief assembly 80 comprises the connector adapter 34, a first ball-joint link 32, a second ball-joint link 32, and a cable strain relief adapter 82. The connector adapter 34 partially encloses and may be molded onto the electrical connector 14, as described above.

The cable strain relief adapter 82 includes a ball relief link 84, a collar receptacle 86, and a relief collar 88. The ball relief link 84 includes an inner surface (not shown) conforming to the outer surface of the ball end 54 of the second ball-joint link 32, as described above. The relief collar 88 is sized and configured to fit over and frictionally retain the electrical cable 16.

It can be appreciated by one skilled in the relevant art that the strain relief assembly 80 is a modified version of the second strain relief assembly 24, shown in FIGS. 4 and 5, with the replacement of the cable adapter 28 by the cable strain relief adapter 82. Accordingly, the first strain relief assembly 22, shown in FIGS. 2 and 3 can likewise be modified (not shown) by the substitution of the cable strain relief adapter 82 for the cable adapter 28.

It is to be understood that the description herein is only exemplary of the invention, and is intended to provide an overview for the understanding of the nature and character of the disclosed illumination systems. The accompanying drawings are included to provide a further understanding of various features and embodiments of the method and devices of the invention which, together with their description serve to explain the principles and operation of the invention.

What is claimed is:

1. A connector strain relief assembly suitable for placement over a junction of an electrical cable and an attached electrical connector, said strain relief assembly comprising:

a connector adapter having (i) a first connector adapter end configured to fit over the electrical connector and (ii) a second connector adapter end, a portion of a surface of said second connector adapter end having a substantially spherical shape;

a cable adapter having (i) a first cable adapter end configured to fit over the electrical cable, and (ii) a second cable adapter end, a portion of a surface of said second cable adapter end having a substantially spherical shape; and, a ball-joint connector having a ball-joint link, wherein said ball-joint link includes a link ball end, wherein said link ball end is rotatably attached to said second connector adapter end, and a link socket end, wherein said link socket end is rotatably attached to said second cable adapter end.

2. The connector strain relief assembly of claim 1 wherein said second connector adapter end comprises a socket end, a portion of an inner surface of said socket end having a substantially spherical shape.

3. The connector strain relief assembly of claim 1 wherein said second connector adapter end comprises a ball end, a portion of an outer surface of said ball end having a substantially spherical shape.

4. The connector strain relief assembly of claim 1 wherein said second cable adapter end comprises a socket end, a portion of an inner surface of said socket end having a substantially spherical shape.

5. The connector strain relief assembly of claim 1 wherein said second cable adapter end comprises a ball end, a portion of an outer surface of said ball end having a substantially spherical shape.

6. The connector strain relief assembly of claim 1, wherein a portion of an outer surface of said link ball end comprises a substantially spherical shape.

7. The connector strain relief assembly of claim 1, wherein a portion of an inner surface of said link socket end comprises a substantially spherical shape.

8. The connector strain relief assembly of claim 1 wherein said connector strain relief assembly comprises a hollow configuration so as to allow the electrical cable to extend from said first cable adapter end to said electrical connector.

9. The connector strain relief assembly of claim 1 further comprising a relief collar disposed on the electrical cable proximate said cable adapter.

10. An electrical cable assembly suitable for providing conductive paths for electrical signals and electrical power between a first external electrical connector and a second external electrical connector, said electrical cable assembly comprising:

a first electrical connector configured to mate with the first external connector;

a second electrical connector configured to mate with the second external connector;

an electrical cable connected to said first electrical connector to form a first junction, said electrical cable further connected to said second electrical connector to form a second junction;

a first connector strain relief assembly disposed over said first junction, said first connector strain relief assembly including (i) a first connector adapter having a link ball end and a link socket end, said link socket end of said first connector adapter partially enclosing said first electrical connector, (ii) a first ball-joint connector attached from a link ball end of said first ball-joint connector to said link ball end of said first connector adapter, and (iii) a first cable adapter rotatably attached at a link ball end of said first cable adapter to a link socket end of said first ball-joint connector, said first cable adapter attached from a link cable end of said first cable adapter to said electrical cable; and, a second connector strain relief assembly disposed over said second junction, said second connector strain relief assembly including (i) a second connector adapter partially enclosing said second electrical connector, (ii) a second ball-joint connector rotatably attached to said second connector adapter, and (iii) a second cable adapter rotatably attached to said second ball-joint connector.

11. A method of providing strain relief for a junction of an electrical cable and an electrical connector, said method comprising the steps of:

placing a cable adapter over said electrical cable, wherein said cable adapter having a socket end in contact with said electrical cable and a link ball end facing said junction;

placing a ball-joint connector over the said electrical cable, wherein said ball-joint connector is rotatably attached from a link ball end of said ball-joint connector to said link ball end of said cable adapter;

placing a connector adapter having a connector end and a link ball end over said electrical cable, wherein said link ball end of said connector adapter is rotatably attached to a link socket end of said ball-joint connector; and attaching said electrical connector to said electrical cable includes the step of attaching said connector end of said connector adapter to said electrical connector such that said electrical connector is partially enclosed by said connector end of said connector adapter.

12. The method of claim 11 wherein said step of attaching said electrical connector to said electrical cable comprises the step of molding a second end of said connector adapter to said electrical connector.

* * * * *